US008844175B2

(12) United States Patent
Snyder

(10) Patent No.: US 8,844,175 B2
(45) Date of Patent: Sep. 30, 2014

(54) WEAR ASSEMBLY FOR EXCAVATING EQUIPMENT

(75) Inventor: Christopher D. Snyder, Portland, OR (US)

(73) Assignee: ESCO Corporation, Portland, OR (US)

( * ) Notice: Subject to any disclaimer, the term of this patent is extended or adjusted under 35 U.S.C. 154(b) by 447 days.

(21) Appl. No.: 12/913,071

(22) Filed: Oct. 27, 2010

(65) Prior Publication Data

US 2011/0099862 A1 May 5, 2011

Related U.S. Application Data

(60) Provisional application No. 61/256,561, filed on Oct. 30, 2009.

(51) Int. Cl.
*E02F 9/28* (2006.01)

(52) U.S. Cl.
CPC ..... *E02F 9/2858* (2013.01); *E02F 9/2866* (2013.01); *E02F 9/2833* (2013.01); *E02F 9/2825* (2013.01)
USPC ..... 37/452; 37/455

(58) Field of Classification Search
USPC ..... 37/452, 453, 455; 172/713
See application file for complete search history.

(56) References Cited

U.S. PATENT DOCUMENTS

| | | | | |
|---|---|---|---|---|
| 784,116 | A | 3/1905 | McCaskey | |
| 1,218,841 | A | 3/1917 | Dietz | |
| 1,438,001 | A | 12/1922 | Buskirk et al. | |
| 1,685,196 | A * | 9/1928 | Gilbert | 172/703 |
| 2,040,085 | A | 5/1936 | Fykse et al. | |
| 2,050,014 | A | 8/1936 | Morrison | |
| 2,167,425 | A | 7/1939 | Page | |
| 2,256,488 | A * | 9/1941 | Murtaugh | 37/455 |
| 2,689,419 | A | 9/1954 | Daniels et al. | |
| 2,738,602 | A | 3/1956 | Meeks | |
| 2,874,491 | A | 2/1959 | Larsen | |
| 2,904,909 | A | 9/1959 | Ratkowski | |
| 2,915,290 | A | 12/1959 | Petersen | |
| 2,919,506 | A | 1/1960 | Larsen | |
| 3,012,346 | A | 12/1961 | Larsen | |
| 3,079,710 | A | 3/1963 | Larsen et al. | |
| 3,196,956 | A * | 7/1965 | Ratkowski | 172/713 |
| 3,331,637 | A | 7/1967 | Krekeler | |
| 3,444,633 | A * | 5/1969 | Hensley | 37/452 |
| 3,455,040 | A | 7/1969 | Ratkowski | |
| 3,530,601 | A | 9/1970 | Steil | |
| 3,623,247 | A | 11/1971 | Stepe | |
| 3,624,827 | A * | 11/1971 | Liess et al. | 37/92 |
| 3,774,324 | A | 11/1973 | Lafond | |

(Continued)

FOREIGN PATENT DOCUMENTS

| | | |
|---|---|---|
| JP | 50-132703 | 10/1975 |
| JP | 61176724 | 8/1986 |

(Continued)

*Primary Examiner* — Jamie L McGowan
(74) *Attorney, Agent, or Firm* — Steven P. Schad

(57) ABSTRACT

Wear members for use in excavating include a socket having a front stabilizing end that includes a top surface, a bottom surface and side surfaces. At least one of these surfaces is formed with a transverse, inward projection and extends axially substantially parallel to the longitudinal axis of the socket. The socket may include surfaces that generally correspond to exterior surfaces of a nose on which it may be mounted and on which it may be connected to excavating equipment.

21 Claims, 9 Drawing Sheets

(56) References Cited

U.S. PATENT DOCUMENTS

| | | | | |
|---|---|---|---|---|
| 3,897,642 | A | 8/1975 | Helton et al. | |
| 3,959,901 | A | 6/1976 | Klett | |
| 3,982,339 | A | 9/1976 | Nilsson | |
| 4,027,408 | A | 6/1977 | Ramella et al. | |
| 4,317,300 | A | 3/1982 | Emrich et al. | |
| 4,319,415 | A | 3/1982 | Mayerbock et al. | |
| 4,335,532 | A | 6/1982 | Hahn et al. | |
| 4,404,760 | A | 9/1983 | Hahn et al. | |
| D274,434 | S | 6/1984 | Nilsson | |
| 4,470,210 | A | 9/1984 | Hahn | |
| D275,859 | S | 10/1984 | Nilsson | |
| 4,481,728 | A | 11/1984 | Mulder et al. | |
| 4,510,706 | A | 4/1985 | Berchem | |
| 4,577,423 | A | 3/1986 | Hahn | |
| 4,611,418 | A | 9/1986 | Launder | |
| 4,625,439 | A | 12/1986 | Johansson et al. | |
| 4,727,663 | A | 3/1988 | Hahn | |
| 4,744,692 | A | 5/1988 | Olsen et al. | |
| D296,442 | S * | 6/1988 | Broomhall | D15/29 |
| 4,751,785 | A | 6/1988 | Johansson et al. | |
| 5,074,062 | A | 12/1991 | Hahn et al. | |
| 5,152,088 | A | 10/1992 | Hahn et al. | |
| 5,177,886 | A | 1/1993 | Klett | |
| 5,350,022 | A | 9/1994 | Launder et al. | |
| D354,291 | S | 1/1995 | Edwards | |
| 5,653,048 | A | 8/1997 | Jones et al. | |
| D389,844 | S | 1/1998 | Moreno | |
| D414,193 | S | 9/1999 | Launder et al. | |
| D417,877 | S | 12/1999 | Launder et al. | |
| 6,047,487 | A | 4/2000 | Clendenning | |
| 6,240,663 | B1 | 6/2001 | Robinson | |
| 6,247,255 | B1 | 6/2001 | Clendenning | |
| D446,224 | S | 8/2001 | Clendenning | |
| D447,154 | S | 8/2001 | Clendenning | |
| 6,321,471 | B2 | 11/2001 | Fernandez et al. | |
| 6,385,871 | B1 * | 5/2002 | Quarfordt | 37/457 |
| 6,393,739 | B1 | 5/2002 | Shamblin et al. | |
| 6,430,851 | B1 | 8/2002 | Clendenning | |
| 6,439,796 | B1 | 8/2002 | Ruvang et al. | |
| 6,477,796 | B1 | 11/2002 | Cornelius | |
| 6,619,883 | B2 * | 9/2003 | Livesay et al. | 404/124 |
| 6,675,509 | B2 | 1/2004 | Bierwith | |
| 6,729,052 | B2 | 5/2004 | Ollinger, IV et al. | |
| 6,735,890 | B2 | 5/2004 | Carpenter et al. | |
| 6,745,503 | B1 | 6/2004 | Moreno et al. | |
| 6,836,983 | B2 | 1/2005 | Moreno et al. | |
| 6,839,990 | B2 | 1/2005 | Leslie et al. | |
| 6,865,828 | B1 | 3/2005 | Molino et al. | |
| 6,976,325 | B2 | 12/2005 | Robinson et al. | |
| 7,523,572 | B2 | 4/2009 | Pasqualini | |
| 7,703,224 | B2 * | 4/2010 | Karlsson et al. | 37/457 |
| 7,730,651 | B2 | 6/2010 | Carpenter | |
| 7,762,015 | B2 * | 7/2010 | Smith et al. | 37/455 |
| 7,980,011 | B2 * | 7/2011 | Ruvang | 37/452 |
| 8,061,064 | B2 * | 11/2011 | Ollinger et al. | 37/453 |
| 2001/0001352 | A1 | 5/2001 | Fernandez et al. | |
| 2003/0005606 | A1 | 1/2003 | Carpenter et al. | |
| 2003/0024139 | A1 | 2/2003 | Jones et al. | |
| 2003/0089003 | A1 | 5/2003 | Ollinger, IV et al. | |
| 2003/0101627 | A1 | 6/2003 | Robinson et al. | |
| 2004/0093771 | A1 | 5/2004 | Carpenter et al. | |
| 2004/0118021 | A1 | 6/2004 | Renski | |
| 2005/0050775 | A1 | 3/2005 | Clendenning et al. | |
| 2005/0055853 | A1 | 3/2005 | Livesay et al. | |
| 2005/0120596 | A1 | 6/2005 | Kasim | |
| 2005/0132619 | A1 | 6/2005 | Robinson | |
| 2006/0013648 | A1 | 1/2006 | Bernstein | |
| 2007/0193075 | A1 | 8/2007 | Carpenter | |
| 2007/0227051 | A1 | 10/2007 | Carpenter et al. | |
| 2008/0000114 | A1 | 1/2008 | Bentley | |

FOREIGN PATENT DOCUMENTS

| | | | |
|---|---|---|---|
| JP | 04306329 | A | 10/1992 |
| JP | 10183698 | A | 7/1998 |
| WO | WO 8703316 | A1 | 6/1987 |
| WO | WO 2004035945 | A1 | 4/2004 |
| WO | WO 2008/140993 | | 11/2008 |

* cited by examiner

WEAR ASSEMBLY FOR EXCAVATING EQUIPMENT

RELATED APPLICATION DATA

This application claims priority benefits to U.S. Provisional Patent Application No. 61/256,561 filed Oct. 30, 2009 in the name of Christopher Snyder and entitled "Wear Assembly for Excavating Equipment, which application is entirely incorporated herein by reference.

FIELD OF THE INVENTION

The present invention pertains to wear assemblies for securing wear members to excavating equipment, such as wear assemblies that are suited for attachment to and use on a dredge cutterhead.

BACKGROUND

Dredge cutterheads are used for excavating earthen material that is underwater, such as a riverbed. In general, a dredge cutterhead 1 includes several arms 2 that extend forward from a base ring 3 to a hub 4 (FIG. 1). The arms 2 are spaced about the base ring 3 and formed with a broad spiral about the central axis of the cutterhead 1. Each arm 2 is provided with a series of spaced apart teeth 5 to dig into the ground. The teeth 5 are composed of adapters or bases 6 that are fixed to the arms 2, and points 7 that are releasably attached to the bases 6 by locks 8.

In use, the cutterhead 1 is rotated about its central axis to excavate the earthen material. A suction pipe is provided near the ring 3 to remove the dredged material. To excavate the desired swath of ground, the cutterhead 1 is moved side-to-side as well as forward. On account of swells and other movement of the water, the cutterhead 1 also tends to move up and down, and periodically impacts the bottom surface. Further difficulties are caused by the operator's inability to see the ground that is being excavated underneath the water; i.e., unlike most other excavating operations, the dredge cutterhead 1 cannot be effectively guided by the operator along a path to best suit the terrain to be excavated.

During a dredging operation, the cutterheads 1 are rotated such that the teeth 5 are driven into and through the ground at a rapid rate. Consequently, considerable power is needed to drive the cutterhead 1, particularly when excavating in rock. In an effort to minimize the power requirements, dredge points 7 are typically provided with elongate, slender bits for easier penetration of the ground. However, as the bit becomes shorter due to wear, the mounting sections of the points 7 will begin to engage the ground in the cutting operation. The mounting section is wider than the bit and is not shaped for reduced drag. On account of the resulting increased drag the mounting sections impose on the cutterhead 1, the points 7 usually are changed at this time before the bits are fully worn away.

In view of the heavy loads and severe environments in which dredging equipment operates, the point 7 and base 6 interconnection for the teeth 5 needs to be stable and secure. Unstable and insecure engagement between the points 7 and their bases 6 may result in undesired disengagement of the points 7 from the base 6, which increases time and expense in the dredging operation, e.g., due to lost parts, downtime for replacement of the points, etc. Accordingly, improved point and base interconnections in dredging and other excavating equipment would be a welcome advance in the art.

SUMMARY OF THE INVENTION

The following presents a general summary of aspects of the present invention in order to provide a basic understanding of the invention and various example features of it. This summary is not intended to limit the scope of the invention in any way, but it simply provides a general overview and context for the more detailed description that follows.

Aspects of this invention relate to wear members for use in excavating equipment, assemblies including a wear member engaged with a base for use with a piece of excavating equipment, and excavating equipment that includes wear members and/or assemblies in accordance with this invention. More specific example aspects of this invention are described in more detail below.

In accordance with one aspect of the invention, a wear member for excavating equipment includes a front surface for engaging the material to be excavated and a rear socket for receiving a base secured to the excavating equipment. The socket has a front stabilizing end that includes a top surface, a bottom surface and side surfaces. At least one of these surfaces is formed with a transverse, inward projection. In some example structures according to this invention, the transverse, inward projection(s) will extend axially substantially parallel to the longitudinal axis of the socket. Additionally, in some structures according to the invention, at least the top surface and the bottom surface will include the transverse, inward projections and/or the substantially parallel axial extension direction.

In accordance with another aspect of the invention, the wear member includes a socket for receiving a base, wherein the socket has top, bottom and side surfaces, and wherein at least one of the surfaces is formed with a transverse inward projection extending substantially along the entire length of the socket.

In accordance with another aspect of the invention, the wear member includes a socket for receiving a base, wherein the socket has top, bottom and side surfaces, wherein at least one of the surfaces includes a first axial portion at a front end of the socket and a second axial portion proximate a rear end of the socket, and wherein each axial portion is formed with a transverse inward projection and extends axially substantially parallel to the longitudinal axis of the socket.

In accordance with another aspect of the invention, the wear member includes a socket for receiving a base fixed to the excavating equipment, and the socket has a front stabilizing end that includes a top surface, a bottom surface, a first side surface, and a second side surface. At least one of the top surface, the bottom surface, the first side surface, and the second side surface has a curved construction, e.g., a curved construction including a curved inward projection.

In accordance with one aspect of this invention, a wear member for excavating equipment is provided with a socket that includes a pair of axially spaced apart stabilizing bands that extend substantially around the perimeter of the socket, with one band near the front end of the socket and another band near the rear end. The stabilizing bands are defined by stabilizing surfaces that each extends substantially parallel to the longitudinal axis of the wear member and/or the assembly in which it is included. In one preferred embodiment, each of the stabilizing bands defines a generally trapezoidal shape.

In accordance with another aspect of the invention, a wear member for excavating equipment is formed to minimize the drag associated with the digging operation and, in turn, minimize the power need to drive the equipment. Reduced power consumption, in turn, leads to a more efficient operation.

In one other aspect of the invention, the wear member is provided with side relief not only in the working end, but also in the mounting end, to reduce drag, require less digging power, and provide a longer useable life for the wear member.

In another aspect of the invention, the wear member has a transverse configuration where the width of the leading side is larger than the width of the corresponding trailing side so that the sidewalls of the wear member follow in the shadow of the leading side to decrease drag. This use of a smaller trailing side is provided not only through the working end of the wear member but also at least partially into its mounting end. As a result, the drag experienced by a worn wear member is less than that of a conventional wear member. Less drag translates into less power consumption and a longer use of the wear member before it needs to be replaced. Accordingly, the working ends of the wear member can be fully or nearly worn away before replacement is needed.

The wear member may have a profile that is defined by the collective transverse configuration of that portion of the wear member that is driven through the ground in any one digging pass. In one other aspect of the present invention, the profile is widest at the leading face and generally narrows rearward of the leading face for the portions of the wear member that will engage the ground during the life of the wear member.

In another aspect of the invention, the exterior transverse profile of the wear member may be generally trapezoidal with the leading side defusing the larger width. The trapezoidal shape continues through the working end and at least through the front portion of the mounting end.

The socket of the wear member is provided to receive a nose of a base member that may be fixed to the excavating equipment. In another aspect of the invention, the socket is formed with a transverse generally trapezoidal exterior shape to generally correspond to the exterior profile of the wear member. This general matching of the socket to the exterior of the mounting section eases manufacture, maximizes the size of the nose for a given outer profile, and enhances the strength to weight ratio.

In a preferred construction, one or more of the top, bottom or side surfaces of a trapezoidal shaped nose and the corresponding walls of the socket are each bowed to fit together. These surfaces and walls have a gradual curvature to ease installation, enhance stability of the wear member, and resist rotation of the wear member about the longitudinal axis during use.

In accordance with another aspect of the invention, both the socket and nose include front and rear stabilizing surfaces (e.g., stabilizing bands, as described above) that extend substantially parallel to the longitudinal axis of the wear member and substantially around the perimeter of the socket and nose to resist rearward loads applied in all directions.

In accordance with another aspect of the invention, the socket and nose are formed with complementary front bearing faces (or thrust faces) that may constitute an arc or section of a sphere to lessen stress in the components and to better control the rattle that occurs between the wear member and the base.

In another aspect of the invention, the socket and nose are formed with front curved bearing faces at their front ends, and with generally trapezoidal transverse shapes rearward of the front ends to improve stability, ease manufacture, maximize the size of the nose, reduce drag, stress and wear, and enhance the strength to weight ratio.

In accordance with another aspect of the invention, a wear assembly is provided that includes a base, a wear member that mounts to the base, and a lock or engagement system that holds the wear member to the base in a manner that is secure, easy to use, and readily manufactured. The lock or engagement system may be axially oriented that, in a compressive state, it holds the wear member to the base and can tighten the fit of the wear member on the base. In one preferred example structure, the wear assembly includes an adjustable axial lock.

In another aspect of the invention, the wear member includes an opening into which the lock or engagement system is received, and a hole that is formed in a rear wall of the opening to accommodate passage of a lock to stabilize the lock and to facilitate easy tightening of the lock.

In another aspect of the invention, the base interacts with the lock solely through the use of a projecting stop. As a result, there is no need for a hole, recess or passage in the nose such as is typically provided to receive a lock. The nose strength is thus enhanced.

In another aspect of the invention, the locking arrangement for securing the wear member to the base can be adjusted to consistently apply a predetermined force to the wear member irrespective of the amount of wear that may exist in the base and/or wear member.

In another aspect of the invention, the wear member includes a marker that can be used to identify when the lock has been adequately tightened.

In another aspect of the invention, the wear member is installed and secured to the base through an easy to use process involving an axial lock. The wear member fits over a nose of a base fixed to the excavating equipment. The base includes a stop that projects outward from the nose. An axial lock is received into an opening in the wear member and extends between the stop and a bearing surface on the wear member to releasably hold the wear member to the nose.

In another aspect of the invention, the wear member is first slid over a base fixed to the excavating equipment. An axially oriented lock is positioned with one bearing face against a stop on the base and another bearing face against a bearing wall on the wear member such that the lock is in axial compression. The lock is adjusted to move and hold the wear member tightly onto the base.

In another aspect of the invention, a lock to releasably hold a wear member to a base includes a threaded linear shaft, with a bearing end and a tool engaging end, a nut threaded onto the shaft, and a spring including a plurality of alternating annular elastomeric disks and annular spacers fit about the threaded shaft between the bearing end and the nut.

Other aspects, advantages, and features of the invention will be described in more detail below and will be recognizable from the following detailed description of example structures in accordance with this invention.

BRIEF DESCRIPTION OF THE DRAWINGS

The present invention is illustrated by way of example and not limited in the accompanying figures, in which like reference numerals indicate the same or similar elements throughout, and in which.

The reader is advised that the various parts shown in these drawings are not necessarily drawn to scale.

DETAILED DESCRIPTION

The following description and the accompanying figures disclose example features of excavating equipment, including wear member structures for excavating equipment in accordance with examples of the present invention as well as structures for mounting such wear members.

Some aspects of the present invention pertain to wear assemblies 100 for excavating equipment, and these wear assemblies may be particularly well suited for dredging operations. In this application, the invention is described primarily in terms of a dredge tooth adapted for attachment to a dredge cutterhead. Nevertheless, the different aspects of the invention can be used in conjunction with other kinds of wear assemblies (e.g., shrouds) and for other kinds of excavating equipment (e.g., buckets or the like for construction or mining equipment, etc.).

The assembly 100 and/or portions thereof are at times described in relative terms such as "up," "down," "horizontal," "vertical," "front" and "rear," and the like. Such terms are not considered essential and are provided simply to ease the description. The orientation of a wear assembly 100 in an excavating operation, and particularly in a dredge operation, can change considerably. These relative terms should be understood with reference to the orientation of wear assembly 100 as illustrated in FIG. 2 unless otherwise stated.

Figure 1:
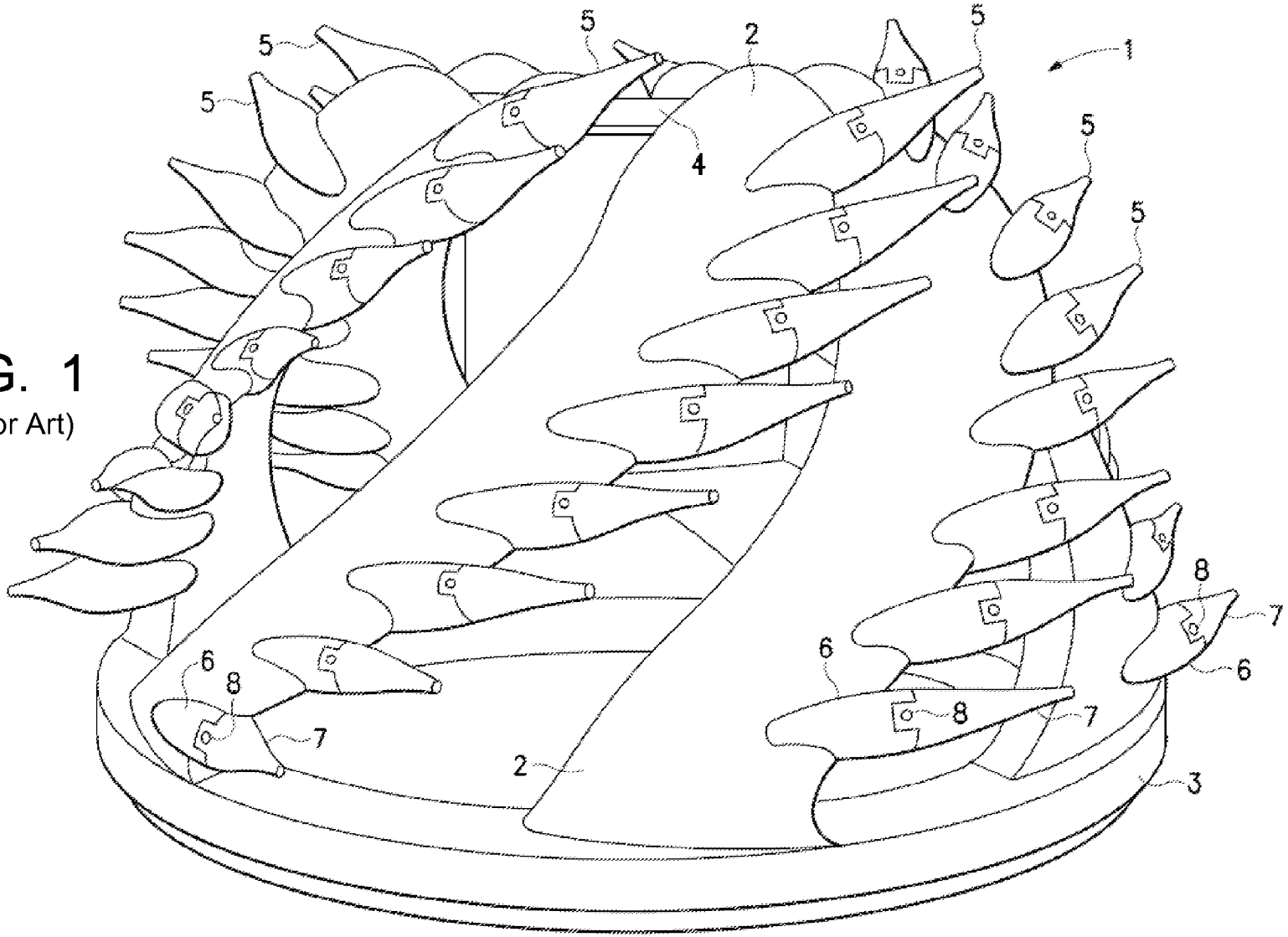
FIG. 1 (Prior Art)
FIG. 1 is a side view of a conventional dredge cutterhead.
Figure 2:
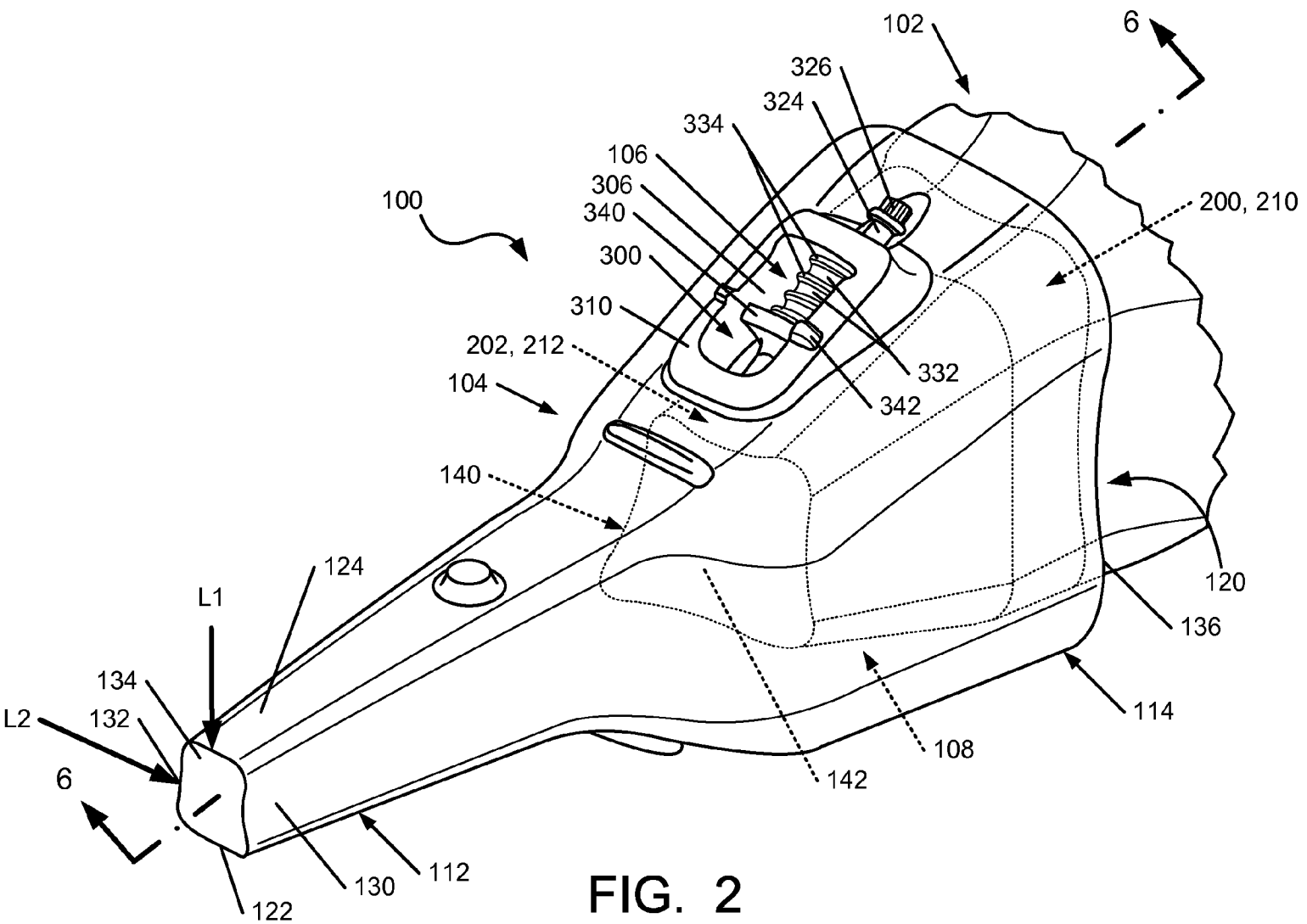
FIG. 2 is a side perspective view of an example wear member in accordance with this invention.
Figure 6:
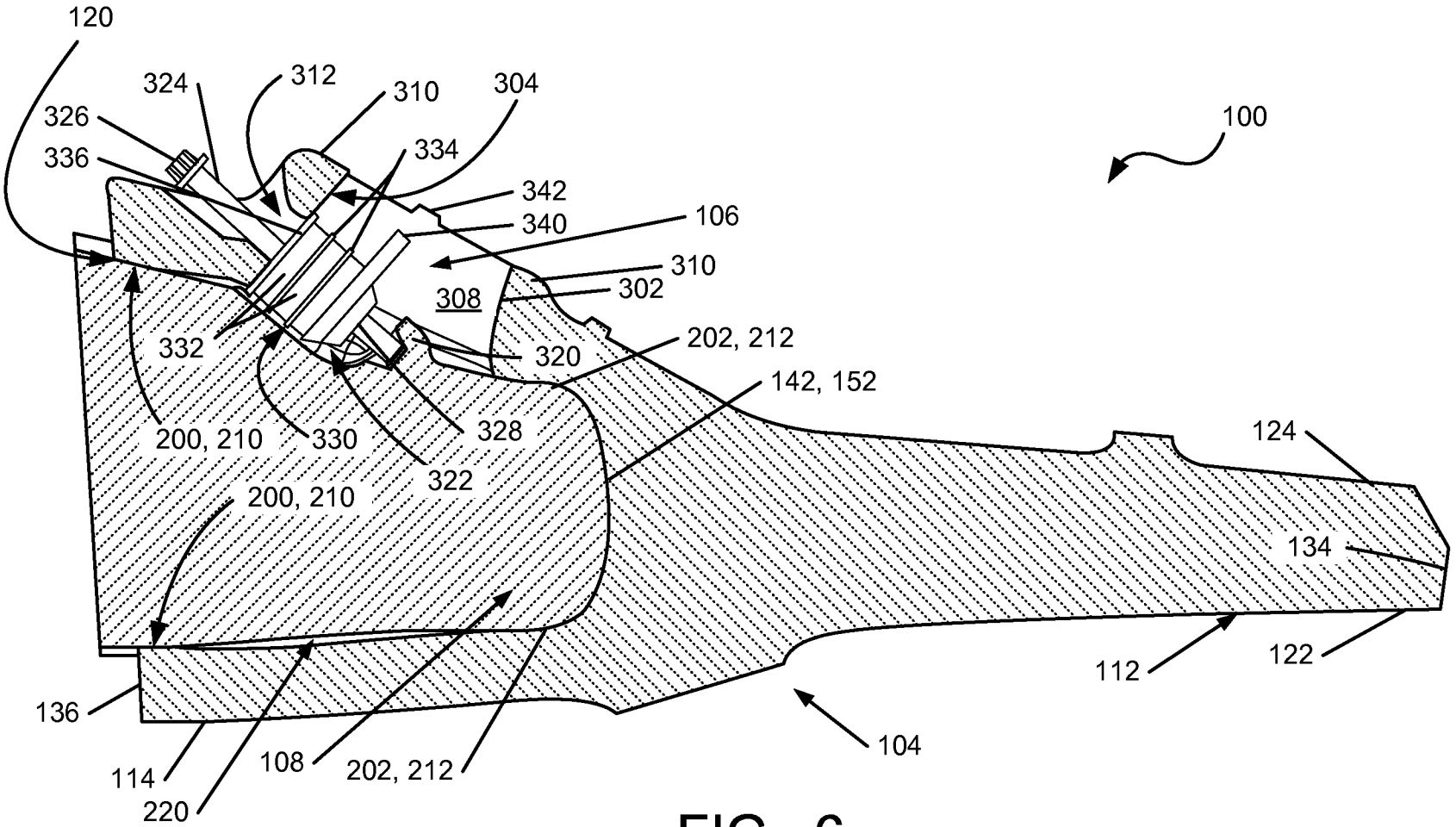
FIG. 6 is a vertical cross sectional view along line 6-6 in FIG. 2 showing the wear member mounted on a nose of a base in accordance with one example of this invention.

Wear assembly 100 includes a base 102 secured to a dredge cutterhead (or other excavating equipment), a wear member 104, and a lock or engagement system 106 to releasably hold the wear member 104 to base 102 (FIGS. 2 and 6). The lock or engagement system could be in the form of a known retainer or pin (not shown), but preferably has a construction as described below.

Base 102 (which also may be referred to herein as an "adapter") includes a forwardly projecting nose 108 onto which wear member 104 is mounted, and a mounting end 110 (see FIG. 3) that is fixed to an arm of a dredge cutterhead (or other excavating equipment). The base 102 may be cast as part of the arm, welded to the arm, or attached by mechanical means. As examples only, the base 102 may be formed and mounted to the cutterhead such as disclosed in U.S. Pat. No. 4,470,210 or U.S. Pat. No. 6,729,052, each of which is entirely incorporated herein by reference. The mounting end 110 may be sized and shaped to prevent rotation with respect to the cutterhead arm and to prevent the assembly 100 from unintentionally separating from the cutterhead arm.

In a dredge tooth, wear member 104 (which also may be referred to herein as a "point") is provided with a working section 112 (also referred to herein as a "bit") in the form of an elongate slender bit and a mounting section 114 that defines a socket 120 to receive nose 108 of the base member 102. Wear member 104 is rotated by the cutterhead such that it engages the ground in generally the same way with each digging pass. As a result, wear member 104 includes a leading side 122 and a trailing side 124. Leading side 122 is the side that first engages and leads the penetration of the ground with each rotation of the cutterhead. In the present invention, trailing side 124 has a smaller width than leading side 122 (i.e., along a plane perpendicular to the longitudinal axis 128 of wear member 104, see FIGS. 7 and 7A) through the working section 112 and at least partially through mounting section 114 (see also FIGS. 7B and 7C). In some embodiments, trailing side 124 has a smaller width than leading side 122 throughout the entire length of the wear member 104.

Figure 7A:
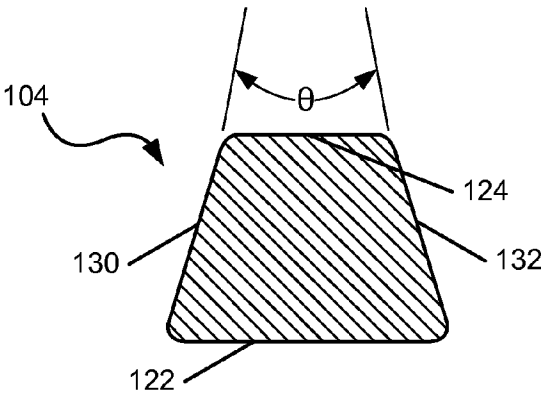
FIG. 7A is a cross sectional view taken along line 7A-7A in FIG. 7 and illustrates a cross section of the working section of the wear member.

As shown in FIGS. 2 and 7A, at least the working section 112 of wear member 104 preferably has a generally trapezoidal transverse configuration with a leading side 122 that is wider than trailing side 124. The term "transverse configuration" is used herein to refer to the two-dimensional configuration along a plane perpendicular to the longitudinal axis 128 of wear member 104. On account of this narrowing of the wear member 104, sidewalls 130 and 132 follow in the shadow of leading side 122 during digging and thereby create little drag on the cutting operation (this reduction in drag feature is also called "side relief" in this specification). In some constructions, sidewalls 130, 132 converge toward trailing side 124 at an angle θ of about 16 degrees (see FIG. 7A); however, other angular configurations are possible. The leading side 122, trailing side 124 and sidewalls 130, 132 can be planar, curved or irregular. Moreover, shapes other than trapezoidal can be used that provide side relief.

In use, the dredge wear member 104 penetrates the ground to a certain depth with each digging pass (i.e., with each rotation of the cutterhead). During much of the wear member's useful life, the working end 112 alone penetrates the ground. As one example, the ground level in one digging cycle extends generally along line 7B-7B in FIG. 7 at the center point of a digging pass. Because only the working end 112 penetrates the ground and because the working end 112 is relatively thin, the drag placed on the digging operation is within manageable limits. Nevertheless, with many dredge teeth being constantly driven through the ground at a rapid rate, power requirements are always high and reducing the drag even in the bit portion 112 of the wear member 104 is beneficial to the operation, especially when digging through rock.

Figure 7:
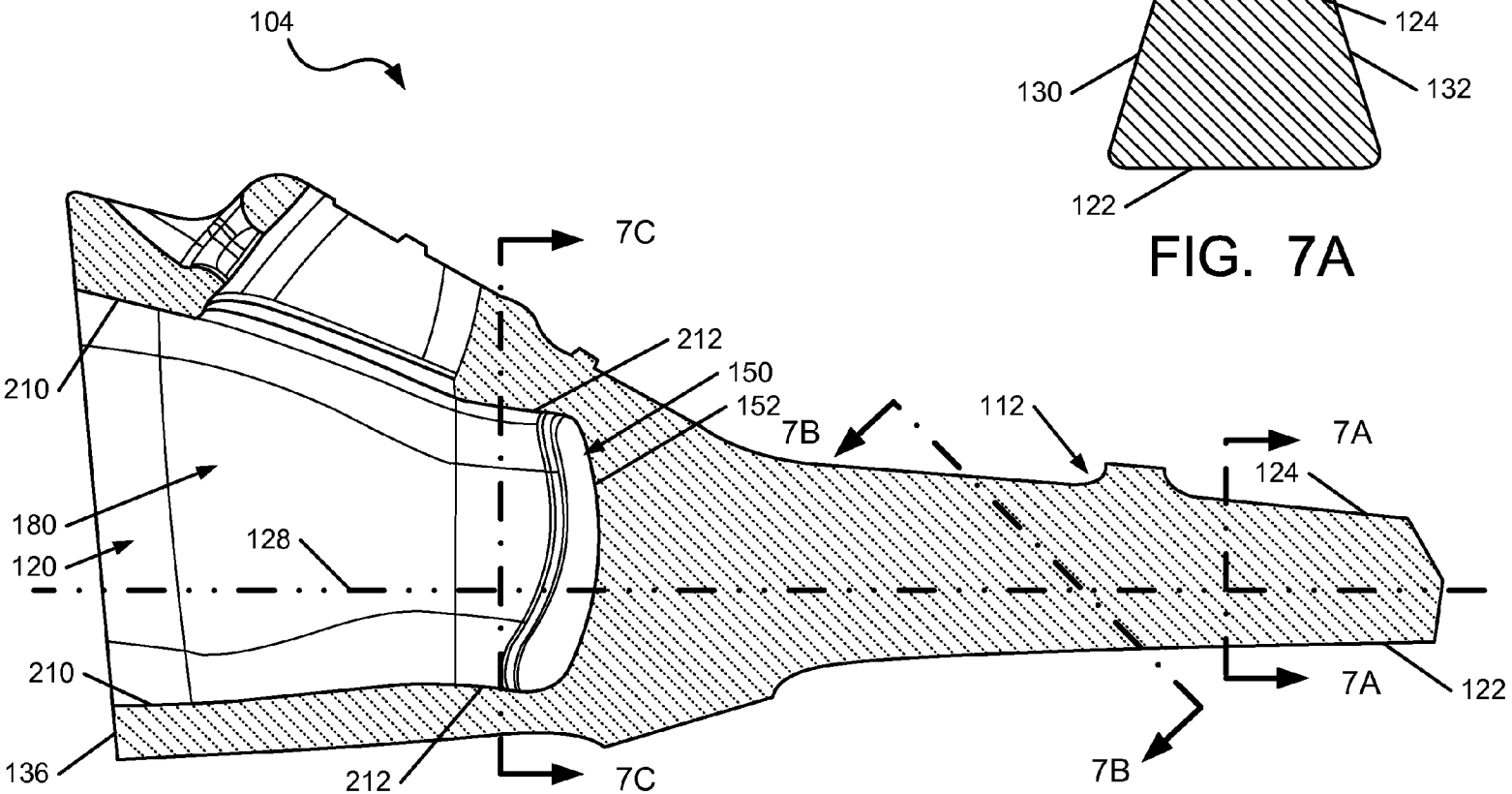
FIG. 7 is a cross sectional view similar to that shown in FIG. 6 except that this example wear member is shown without the base member and the lock, to better illustrate the internal structures of the socket in this example wear member.
Figure 7C:
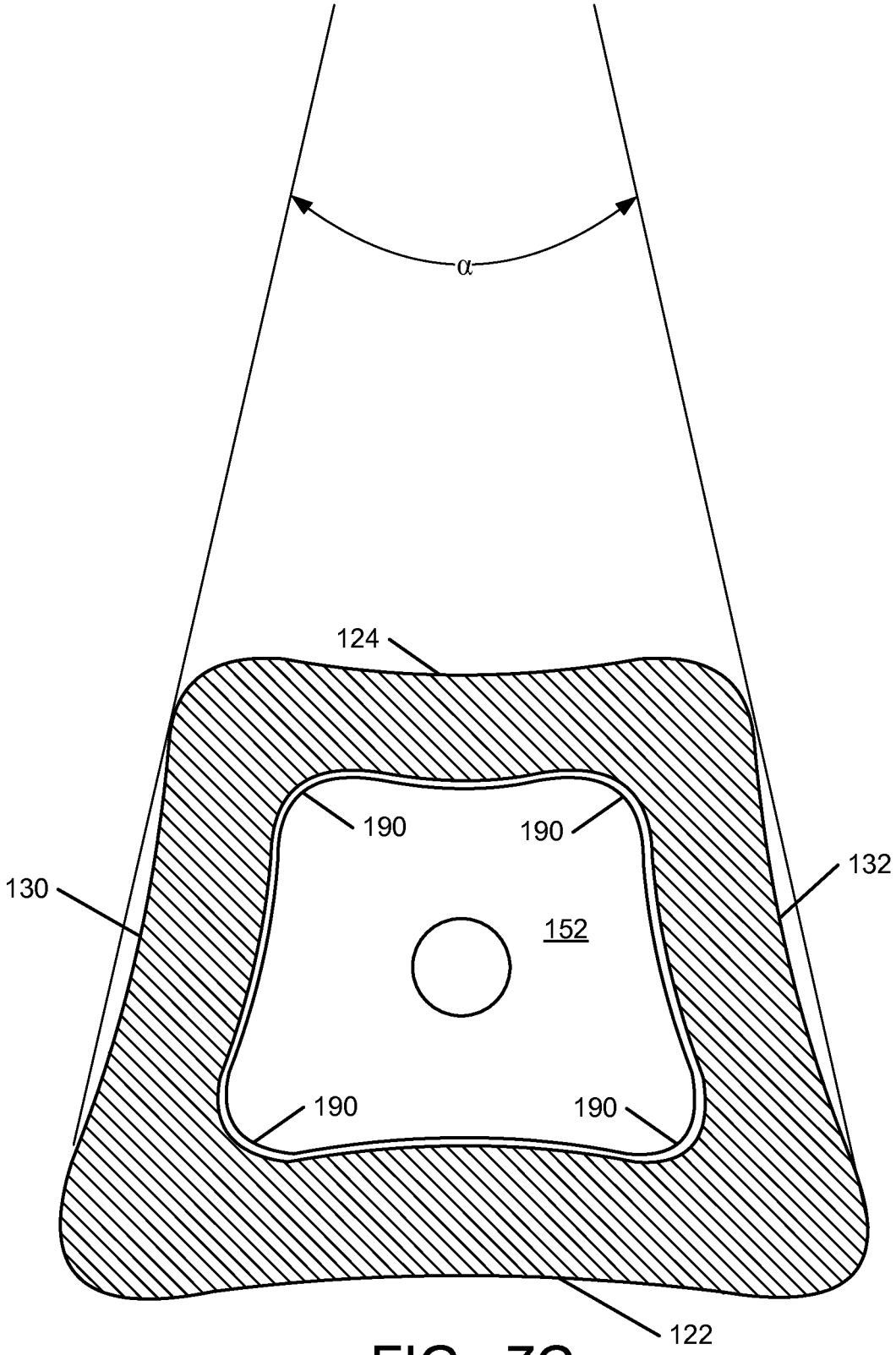
FIG. 7C is a cross sectional view taken along line 7C-7C in FIG. 7 and illustrates a cross section of the mounting section of the wear member.
Figure 7B:
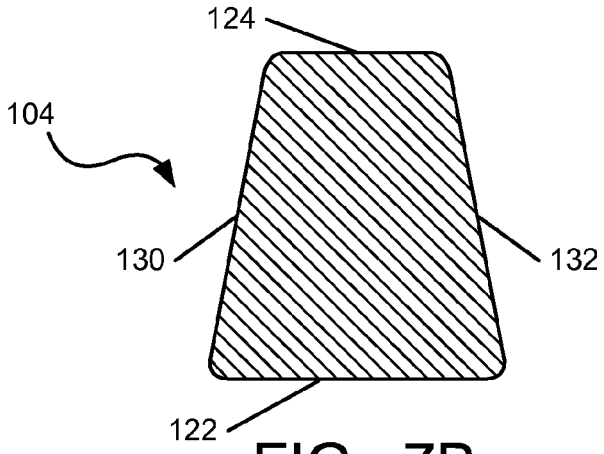
FIG. 7B is a cross sectional view taken along line 7B-7B in FIG. 7 and illustrates a cross section of the wear member as it contacts ground during a digging operation.

In some preferred constructions, sidewalls 130, 132 not only converge toward trailing side 124, but they also are configured so that the sidewalls 130, 132 lie within the shadow of the leading side 122 in the digging profile (FIG. 7B). The term "digging profile" is used herein to mean the cross-sectional configuration of the portion of wear member 104 that penetrates the ground along a plane that is (i) parallel to the direction of travel at the center point of a digging pass through the ground and (ii) laterally perpendicular to the longitudinal axis. The digging profile is a better indication of the drag to be imposed on the wear member 104 during use than a true transverse cross section. The provision of side relief in the digging profile is dependent on the angle at which the sidewalls converge toward the trailing side and the axial slope or expansion of the wear member surfaces in a rearward direction. The intention is to provide a width that generally narrows from the leading side 122 to the trailing side 124 when considered from the perspective of the digging profile. Side relief in the digging profile preferably extends across the expected cutterhead digging angles, but benefit can still be obtained if such side relief exists in at least one digging angle. As one example only, the cross-sectional configuration illustrated in FIG. 7B represents one digging profile for a portion of wear member 104 being driven through the ground. As can be seen, the working end 112 is still provided with side relief even in the digging profile as sidewalls 130, 132 converge toward trailing side 124 for reduced drag.

As the working section 112 wears away, the ground level gradually creeps rearward so that more rearward, thicker portions of the wear member 104 are pushed through the ground with each digging cycle. More power is therefore required to drive the cutterhead as the working members wear. Eventually, enough of the working section 112 wears away such that the mounting section 114 of the wear member 104 is being driven through the ground with each digging pass. In at least some example structures in accordance with the present invention, the mounting section 114 continues to include side relief at least at the front end of the mounting section (FIG. 7C), and preferably throughout the mounting section 114.

As seen in FIGS. 2, 6, and 7, mounting section 114 is larger than working section 112 to accommodate the receipt of nose 108 into socket 120 and to provide ample strength for the interconnection between the wear member 104 and the base 102. Sidewalls 130, 132 are inclined so as to converge toward trailing side 124. The inclination of sidewalls 130, 132 along line 7C-7C is, in this one example, at an angle $\alpha$ of about 26 degrees (FIG. 7B), but other inclinations can also be used. As discussed above, the desired side relief in the digging profile depends on the relation between the transverse inclination of the sidewalls 130, 132 and the axial expansion of the wear member 104.

As noted above, in use, the working section 112 may be worn down to an extent where a portion of mounting section 114 may be driven through the ground during rotation of a cutterhead. If desired, in at least some example structures in accordance with this invention, the tapering of sidewalls 130, 132 continues from front end 134 to rear end 136 of wear member 104. The presence of side relief in the mounting section 114 imposes less drag and, hence, requires less power to be driven through the ground. The reduced drag, in turn, enables the cutterhead to continue to operate with wear members 104 worn to the point where the mounting section 114 penetrates the ground. In most conventional wear members, the mounting section does not have a trapezoidal transverse configuration with sidewalls that converge toward trailing side. The lack of side relief in the digging profile imposes a heavy drag on the conventional wear member as it is driven through the ground especially as compared to the present inventive wear member 104. With the heavy drag produced by conventional wear members in this condition, many operators will replace the wear members when their mounting sections begin to be driven through the ground even though the working sections may not be fully worn out. With at least some examples of the present invention, wear members 104 can stay on bases 102 until working sections 112 are further worn out as compared with many conventional wear members.

The use of a wear member 104 with side relief in the working section 112 and the mounting section 114 as described above can be used with a wide variety of nose and socket configurations. Nonetheless, in at least some example constructions in accordance with this invention, the front end 140 of nose 108 includes a forward-facing bearing or thrust face 142 that is trapezoidally shaped in cross section (FIGS. 2-6). Likewise, the front end 150 of socket 120 formed in the wear member 104 is formed with a complementary trapezoidally shaped bearing or thrust face 152 to set against thrust face 142 (FIGS. 6, 7, 7C, and 9). While the thrust faces 142, 152 may be any desired shape (such as any shape between hemispherical to flat or even concave), in some example structures according to this invention, the thrust face 142 may gently curve outward (e.g., as a portion or arc (or segment) of a sphere) such that its center point (or near its center point) is the forwardmost point of the face 142. In other examples, the thrust face 142 will be convex and curved about two perpendicular axes. The thrust face 152 may be shaped to match or substantially match the shape of the face 142. Matching rounded (e.g., spherical arc) shaped thrust faces 142 and 152 for primary load bearing helps keep the faces 142 and 152 in contact without tipping or shifting as the load on the working section 112 changes over the course of a digging operation (e.g., changes from an axial to a non-axial load, etc.). The thrust faces 142, 152 may be flat, recessed or have other shapes so long as they adequately resist the anticipated thrust loads for the intended use.

Figure 3:
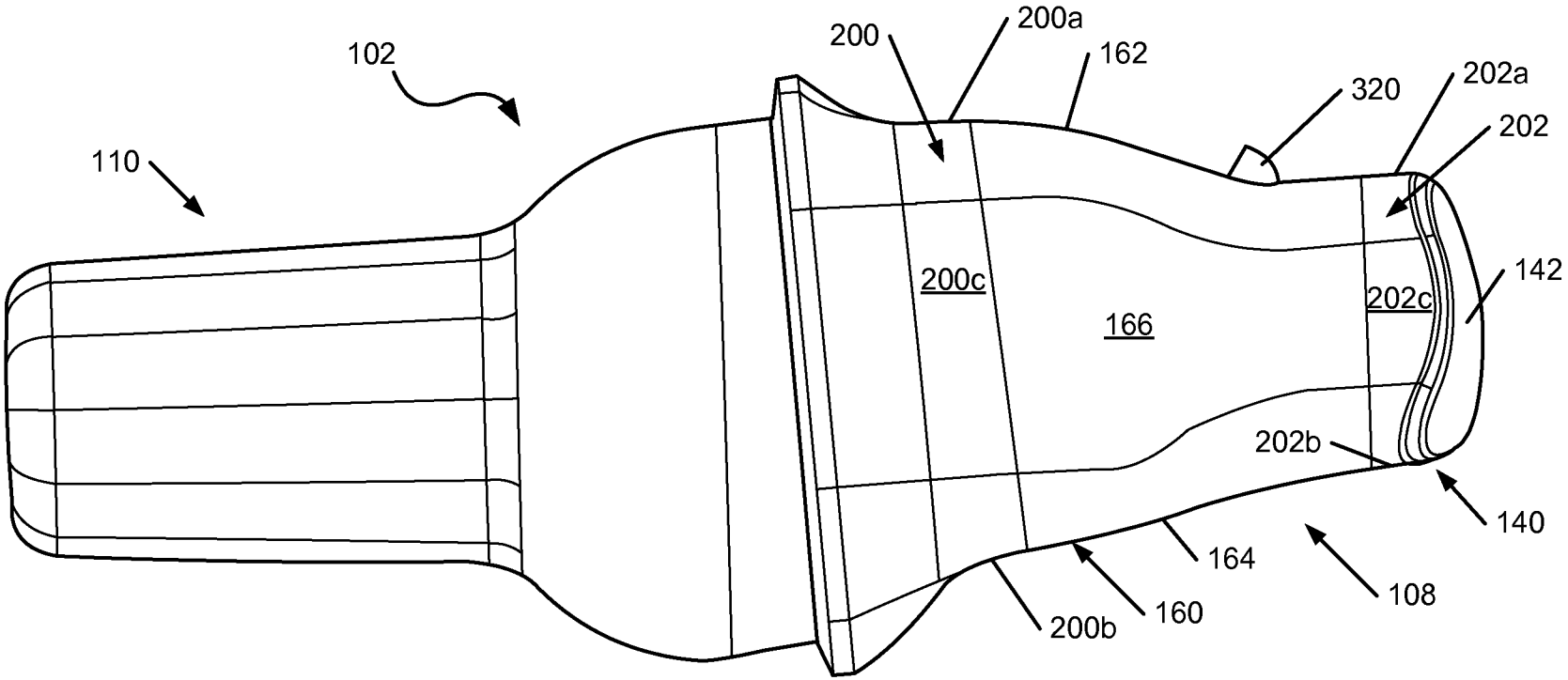
FIG. 3 is a side view of an example base for mounting a wear member in accordance with this invention.
Figure 4:
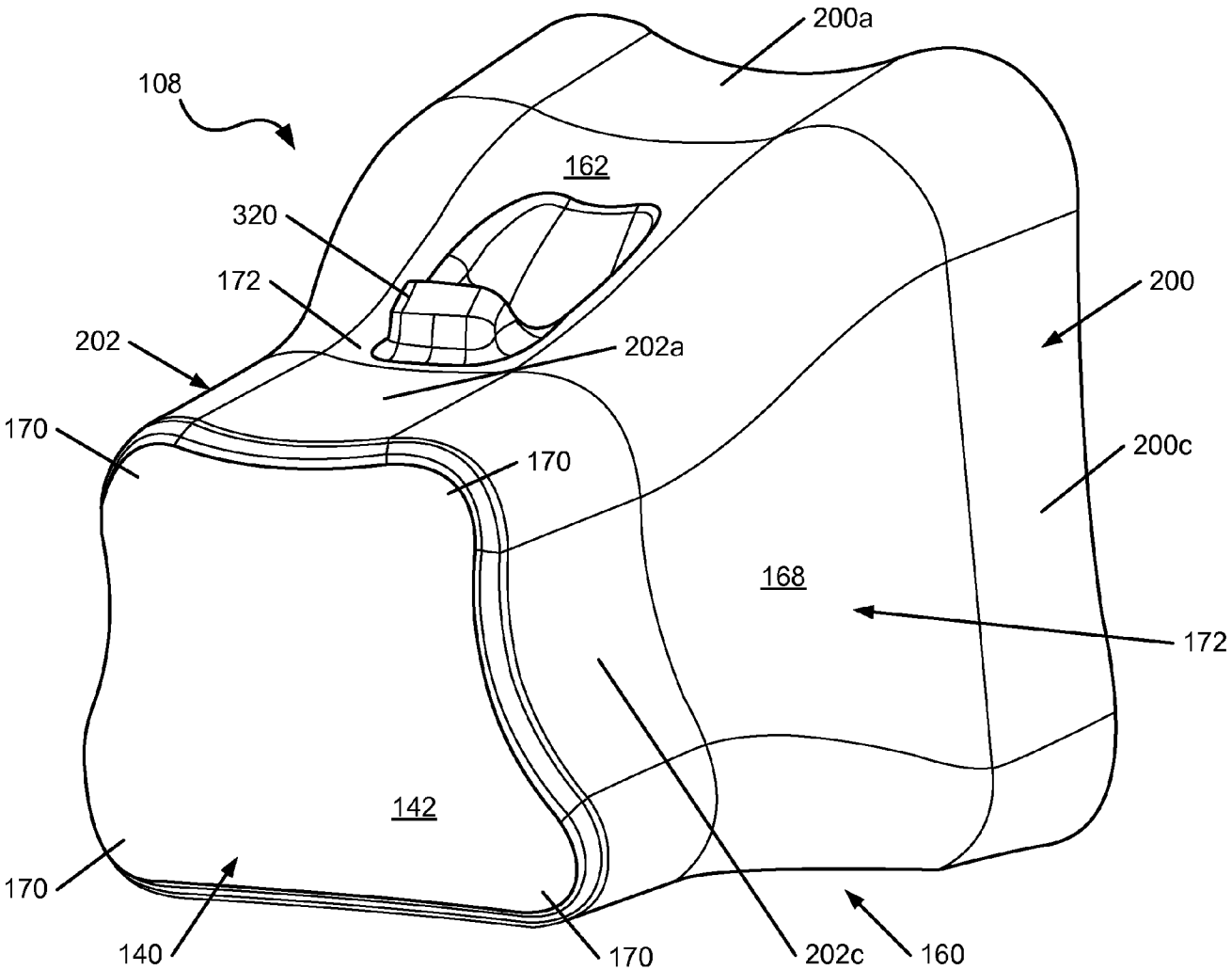
FIG. 4 is a perspective view of an example nose of a base for mounting a wear member in accordance with this invention.
Figure 5:
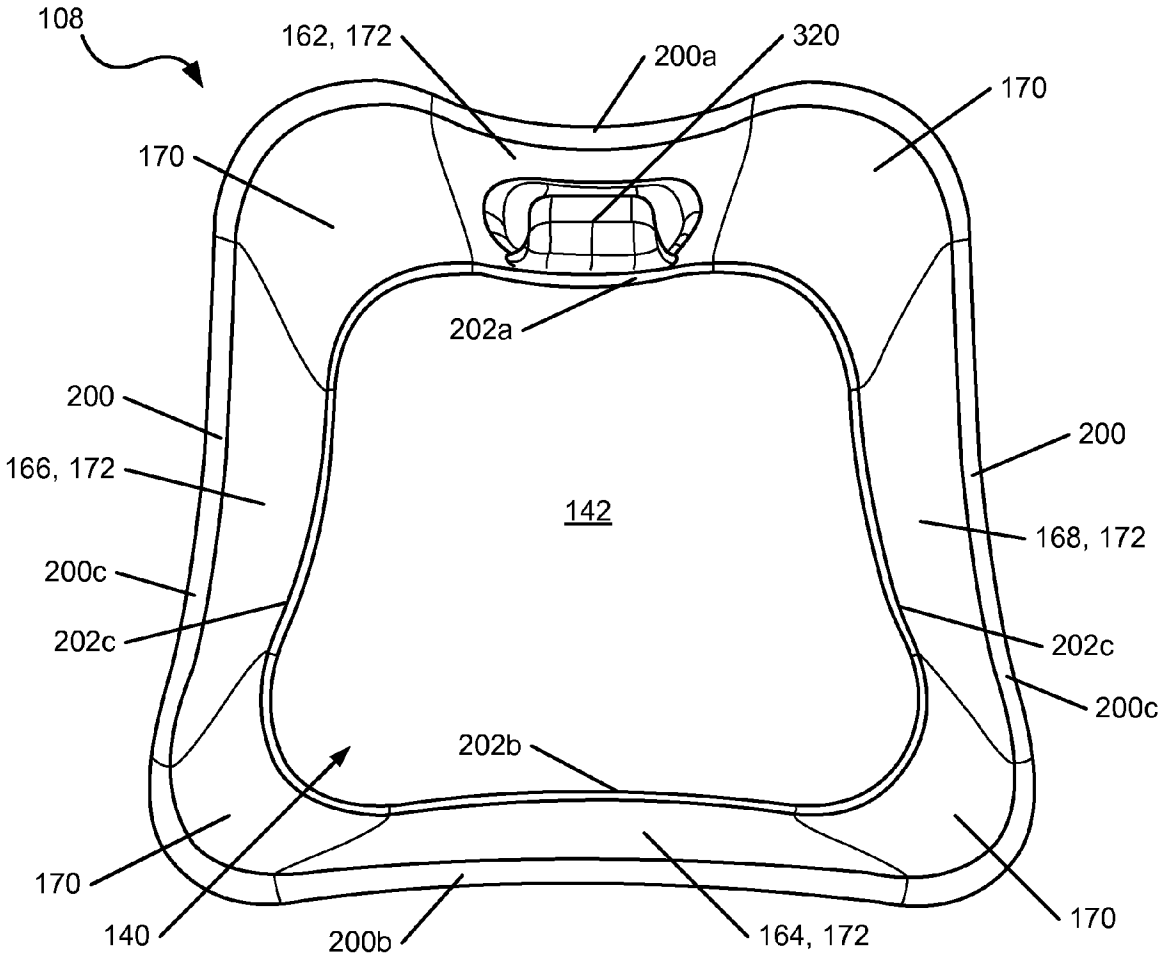
FIG. 5 is a front view of an example nose of a base for mounting a wear member in accordance with this invention.

Nose 108 includes a body 160 rearward of front end 140 (FIGS. 3-5). Body 160 is defined by an upper surface 162, a lower surface 164 and side surfaces 166, 168. In some example constructions, body surfaces 162-168 diverge rearwardly so that nose 108 expands outward from front end 140 to provide a more robust nose to withstand the rigors of digging. Nevertheless, it is possible for only the upper and lower surfaces 162, 164 to diverge from each other and for the side surfaces 166, 168 to axially extend substantially parallel to each other. Socket 120 has a main portion 180 rearward of front end 150 to receive body 160. Main portion 180 includes an upper wall 182, lower wall 184 and sidewalls 186, 188 that generally conform to body surfaces 162-168, respectively. In at least some preferred example configurations according to this invention, body 160 and main portion 180 each have a trapezoidal transverse configuration. The use of a trapezoidal shape predominantly along the length of nose 108 and socket 120 provides four corners 170, 190, which act as spaced ridges to resist turning of wear member 104 about axis 128.

Also, in at least some example constructions in accordance with this invention, at least one of the body surfaces 162-168 and socket walls 182-188 (and preferably all of them) will have mutually bowed configurations (see FIGS. 4, 5, 7, 7C, and 8). In other words, in some example structures according to this invention, body surfaces 162-168 are preferably concave and curved across substantially their entire widths to define a trough 172 on each of the four sides of body 160. Likewise, socket walls 182-188 are preferably convex and curved across substantially their entire widths to define projections 192 received into troughs 172. The preferred bowing of nose surfaces 162-168 and socket walls 182-188 across substantially their entire widths provides increased resistance to the rotation of wear member 104 about base 102 during operation and increases the resistance to vertical and side loading of the point during digging. The troughs and projections will also reduce rotational rattle of the wear member 104 on the base 102. While the bowed surfaces 162-168 and walls 182-188 are preferred, other trough and projection configurations such as disclosed in U.S. patent application Ser. No. 11/706,592, which is incorporated herein by reference, could also be used without departing from the invention. Other rotation resisting constructions could also be used without departing from this invention.

The use of troughs 172 and projections 192, and particularly those that are gradually curved and extending substantially across the entire widths of the surfaces 162-168 and walls 182-188 eases the assembly of wear member 104 onto nose 108; i.e., the troughs 172 and projections 192 cooperatively direct wear member 104 into the proper assembled position on nose 108 during assembly. For example, if wear member 104 is initially installed on nose 108 out of proper alignment with the nose 108 as it is fit onto the nose 108, the engagement of projections 192 being received into the troughs 172 will tend to rotate the wear member 104 into proper alignment as the wear member is fed rearward onto nose 108. This cooperative effect of troughs 172 and projections 192 greatly eases and speeds installation and the setting of corners 170 into corners 190. Some variations could also be used between the shapes of the socket 120 and the nose 108 so long as the socket 120 predominantly matches the shape of the nose 108.

As shown in various figures (e.g., FIGS. 2, 4, 5, 7, 7C, and 8), one or more of the surfaces (e.g., top surface, bottom surface, and side surfaces) at the front end 140 of the nose 108 and the front end 150 of the socket 120 may have a generally curved configuration or construction (e.g., continuously curved from one corner to the next at or near the thrust faces 142 and 152), and the corners also may be rounded. At least some of the surfaces having this curved configuration or construction may include a curved inward projection (e.g., so that the corners of that surface lie outward from the center of that surface with respect to a center of the front end 140 and 150 of the nose 108 and socket 120, respectively). Additional or alternative example features of the nose 108 and socket 120 in accordance with this invention are described in more detail below.

The front end 140 of the nose 108 includes front stabilizing surfaces 202, and more specifically including an upper stabilizing surface 202*a*, a lower stabilizing surface 202*b* and two side stabilizing surfaces 202*c* that collectively extend around the perimeter of front end 140 of nose 108. These stabilizing surfaces 202*a*, 202*b*, 202*c* preferably define a generally trapezoidal configuration though other shapes can be used. In a preferred construction, upper stabilizing surface 202*a* has a shorter width than lower stabilizing surface 202*b* to match the outer profile of wear member 104. Of course, the orientation could be reversed, or other relative sizing options may be provided, as desired for certain applications. Similarly, the interior side walls defining front end 150 of socket 120 include similarly shaped and situated stabilizing surfaces 212*a* through 212*c* that match with and contact stabilizing surfaces 202*a* through 202*c*, respectively. In this illustrated example arrangement, the front stabilizing surfaces on the nose 108 and in the socket 120 provide a front stabilizing end located adjacent the thrust faces 142 and 152 of the nose 108 and socket 120. The top and bottom stabilizing surfaces 202*a*, 202*b*, 212*a*, and 212*b* extend rearward from their respective thrust faces 142 and 152.

Front stabilizing surfaces 202, 212 preferably axially extend substantially parallel to longitudinal axis 128. The term "substantially parallel," as used herein in this context, is intended to include parallel surfaces as well as those that diverge rearwardly from axis 128 at a small angle (e.g., of about 1-7°) for manufacturing or other purposes. In one preferred embodiment, each front stabilizing surface 202, 212 diverges axially rearward at an angle to axis 128 of no more than about 5°, and in some instances, by about 2-3°. The front stabilizing surfaces 202, 212 also preferably encircle (or at least substantially encircle) nose 108 and socket 120 to better resist non-axial loads. However, benefits can be achieved by forming only one or more of the upper surfaces 202*a*, 212*a*, bottom surfaces 202*b*, 212*b*, and side surfaces 202*c*, 212*c* to extend axially substantially parallel to longitudinal axis 128.

Front stabilizing surfaces 202 on front end 140 of the nose 108 are preferably each provided with a transverse, inward recess in a transverse direction (see FIGS. 2 and 5). Likewise, front stabilizing surfaces 212 on front end 150 of the socket 120 are preferably each provided with a corresponding transverse, inward projection. The corresponding inward recesses and projections enable each of the stabilizing surfaces 202, 212 to resist all applied loads irrespective of whether the loads are applied vertically or horizontally (e.g., resist vertical and side loading). For example, when an upward load is vertically applied to the bit of the point, the load is at least in part resisted by lower stabilizing surface 212*b* contacting lower stabilizing surface 202*b*. The use of such corresponding recesses and projections at the front end also enhances installation of the wear members on the bases in the same way as discussed above for the troughs and projections rearward of the front ends 140, 150.

The rear of the nose 108 includes rear stabilizing surfaces 200, and more specifically including an upper stabilizing surface 200*a*, a lower stabilizing surface 200*b* and two side stabilizing surfaces 200*c* that collectively extend around the perimeter of rear end of nose 108. Rear stabilizing surfaces 200 are able to well resist vertical and side loads applied to wear member 104 without tending to push the wear member 104 from base member 102. These stabilizing surfaces 200*a*, 200*b*, 200*c* preferably define a generally trapezoidal configuration around the perimeter of the nose 108, though other shapes could be used. In a preferred construction, upper stabilizing surface 200*a* is narrower than lower stabilizing surface 200*b* to match the outer profile of wear member 104. Similarly, the interior side walls of socket 120 include similarly shaped and situated stabilizing surfaces 210*a* through 210*c* that match with and contact stabilizing surfaces 200*a* through 200*c*, respectively. Of course, the orientation could be reversed, or other relative sizing options may be provided, as desired for certain applications. Further, front and rear stabilizing surfaces 200, 202, 210, 212 preferably form spaced apart bands of stabilizing surfaces that each extends about the entire perimeter of nose 108 and the socket or at least substantially about the entire perimeter, as will be described in more detail below.

More specifically, nose surfaces 162-168 with troughs 172 are each preferably inclined axially to expand outward as they extend rearward to provide strength to nose 108 until reaching the rear stabilizing surfaces 200 of nose 108. Likewise, socket walls 182-188 with projections 192 also each expand to conform to surfaces 162-168. Socket walls 182-188 also define the rear stabilizing surfaces 210 to bear against rear stabilizing surfaces 200. Rear stabilizing surfaces 200, 210 are substantially parallel to longitudinal axis 128. As noted above, the term "substantially parallel," as used herein in this context, is intended to include parallel surfaces as well as those that diverge rearwardly from axis 128 at a small angle (e.g., of about 1-7°) for manufacturing or other purposes. In one preferred embodiment, each rear stabilizing surface 200, 210 diverges axially rearward at an angle to axis 128 of no more than about 7°, and in some instances, by about 2-3°. The rear stabilizing surfaces 200, 210 also preferably encircle (or at least substantially encircle) nose 108 and socket 120 to better resist non-axial loads. Nevertheless, benefits can be realized by including such stabilizing surfaces 200, 210 on only one or more of the upper, lower and side surfaces of the nose 108 and socket 120.

While contact between the various socket 120 surfaces and the nose 108 will likely occur during an excavating operation, contact between the thrust faces 142, 152, the corresponding front stabilizing surfaces 202, 212, and the corresponding rear stabilizing surfaces 200, 210 is intended to provide primary resistance to the applied loads on the tooth and thereby provide the desired stability. While these stabilizing surfaces 200, 202, 210, 212 may be formed with relatively short axial extensions in the longitudinal direction 128, they could have longer or different constructions. The presence of the stabilizing surfaces, particularly front stabilizing surfaces 202 and 212, helps align the wear member 104 as it is installed on the nose 108.

Front stabilizing surfaces 202, 212 and rear stabilizing surfaces 200, 210 are provided to stabilize the wear member 104 on the nose 108 and to lessen stress in the components. The front stabilizing surfaces 202, 212 at the front ends 140, 150 of the nose 108 and socket 120, respectively, are able to stably resist axial and non-axial rearward forces in direct opposition to the loads irrespective of their applied directions. Rear stabilizing surfaces 200, 210 complement the front stabilizing surfaces 202, 212 by reducing the rattle at the rear of the wear member 104 and providing stable resistance to the rear portions of the wear member 104, as described in U.S. Pat. No. 5,709,043 incorporated herein by reference. With stabilizing surfaces 200, 202, 210, and 212 extending about the entire perimeter of nose 108 and socket 120 (or at least substantially about the entire perimeters of these members), they are also able to resist the non-axially directed loads applied in any direction.

Figure 8:
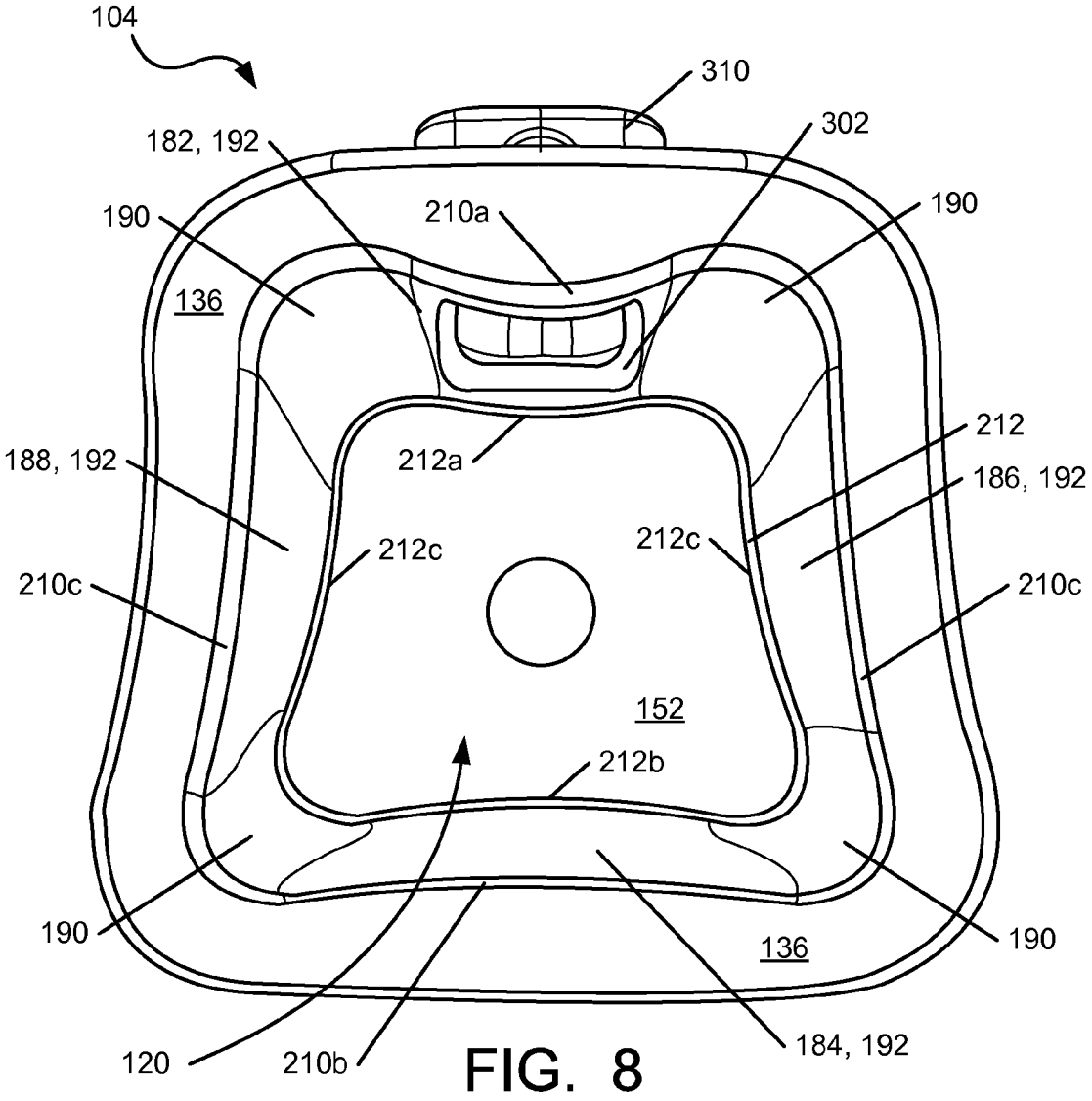
FIG. 8 is an end view of an example wear member in accordance with this invention, looking into the socket.

The main portion of socket 120 preferably has a generally trapezoidal transverse configuration to receive a matingly shaped nose 108 (see FIGS. 7C and 8). The generally trapezoidal transverse configuration of socket 120 generally follows the generally trapezoidal transverse configuration of the exterior of nose 108. This cooperative shaping of the socket 120 and the exterior of nose 108 maximizes the size of the nose 108 that can be accommodated within wear member 104, eases the manufacturing of wear member 104 in a casting process, and enhances the strength to weight ratio. However, a variety of different configurations could be used.

While the nose walls 162-168 and socket walls 182-188 may be generally shaped to match and mate with one another along substantially their entire lengths, there are preferably one or more gaps 220 along a medial portion of the length of nose walls 162-168 and socket walls 182-188, e.g., as shown in FIG. 6 to better ensure contact under load along the front and rear stabilizing surfaces. Gaps may also be provided along other portions of the fit as well. In the example structure shown in FIG. 6, a gap 220 is provided in a central section of the nose and socket, between stabilizing surfaces 200, 202, 210, 212 along each of the upper, lower and side surfaces. These gaps 220 can also help make the nose 108 fit more easily into the socket 120, help ease removal of the nose 108 from the socket 120, and reduce the need for high tolerances and/or precision in the overall manufacture of the nose 108 and socket 120. Because of the presence of the front and rear stabilizing surfaces 200, 202, 210, 212, the gap(s) 220 can be made relatively large to assure that no undesired contact is made (thereby maintaining desired lever arm distances between contacts). The presence of the stabilizing surfaces 200, 202, 210, 212 at both the front and the rear of the nose 108 and within the socket 120 of the working member 104 decreases relative motion between the wear member 104 and the nose 108 and increases the usable lives of these parts.

The spaced bands of front and rear stabilizing surfaces 200, 210 (and the corresponding surfaces in the socket 120) enable the assembly 100 to effectively resist loads applied from all directions. For example, a downward load L1 applied to the front end 134 of wear member 104 (see FIG. 2) will tend to rotate wear member 104 forwardly off nose 108 if not sufficiently resisted. Such loads in assembly 100 are generally resisted by front stabilizing surface 202 (e.g., top surface 202*a*) and rear stabilizing surface 200 (e.g., bottom surface 200*b*) (and the corresponding stabilizing surfaces 212 and 210 provided within the socket 120). Likewise, side loads L2 applied to front end 134 are generally resisted by front stabilizing surface 202*c* on one side and rear stabilizing surface 200*c* on the opposite side (and the corresponding stabilizing surfaces 212 and 210 provided within the socket 120). The use of stabilizing surfaces 200, 202, 210, 212 provides stable resistance to such loads without an undue reliance on lock 106. The use of stabilizing surface bands around the entire or most of the perimeter enables enhanced support in virtually all directions, which is particularly important in a dredging operation. Nevertheless, the stabilizing surface bands need not be formed about the entire perimeter, if desired.

In a preferred embodiment, the upper, lower and side surfaces of the nose 108 and socket 120 are preferably provided with transverse inward recesses on the nose 108 and transverse inward projections on the socket 120 along their entire lengths. However, stability, strength and/or installation benefits can be achieved by providing such a configuration only on the front ends 140, 150 of the nose 108 and socket 120, i.e., with a different shaped nose and socket rearward of the front ends. The front ends 140, 150 preferably are also, as discussed above, formed with stabilizing surfaces that extend axially substantially parallel to the longitudinal axis 128 along with having the transverse inward recesses and projections, but some benefits are achieved even without this preferred axial extension.

A wide variety of different locks can be used to releasably secure wear member 104 to base 102. Nonetheless, in a preferred embodiment, lock 106 is received into an opening 300 in wear member 104, preferably formed in trailing wall 124 though it could be formed elsewhere. Opening 300 preferably has an axially elongated shape and includes a front wall 302, a rear wall 304, and sidewalls 306, 308. As will be described in more detail below, the lock 106 will be engaged to press against rear wall 304 of the opening 300. A rim 310 is built up around opening 300 for protection of the lock 106 and for additional strength. Rim 310 is also enlarged along rear wall 304 to extend farther outward of the exterior surface and to define a hole 312 for passage of lock 106. The hole 312 stabilizes the position of lock 106 and permits easy access to it by the operator.

Nose 108 includes a stop 320 that projects outward from upper side 162 of nose 108 to engage lock 106. Stop 320 preferably has a rear face with a concave, curved recess into which a front end of lock 106 is received and retained during use (see FIG. 6), but other arrangements could be used to engage the lock 106 with the stop 320. In one example construction, opening 300 is long enough and trailing wall 124 sufficiently inclined to provide clearance for stop 320 when wear member 104 is installed onto nose 108. Nevertheless, a relief or other forms of clearance could be provided in socket 120, if needed, for the passage of stop 320. Further, the projection of stop 320 is preferably limited by the provision of a depression 322 to accommodate a portion of lock 106. Preferably, the stop 320 does not include an opening in the nose 108, in order to maintain a stronger and more robust nose construction.

Lock 106 of this example construction may be a linear lock oriented generally axially to hold wear member 104 onto base 102, and to tighten the fit of wear member 104 onto nose 108. The use of a linear lock oriented axially increases the capacity of the lock 106 to tighten the fit of the wear member 104 on the nose 108; i.e., it provides for a greater length of take up and firmly holds the thrust faces 142 and 152 against one another (this face 142 to face 152 contact is one of the primary contact modes between the wear member 104 and the nose 108). In one preferred structural arrangement, lock 106 includes a threaded shaft 324 having a front end and a rear end with head 326, a nut 328 threaded to shaft 324, and a spring 330. Spring 330 is preferably formed of a series of elastomeric disks 332 composed of foam, rubber or other resilient material, separated by spacers 334 which are preferably in the form of washers. Multiple disks 332 may be used to provide sufficient force, resiliency and take up. The spacers 334 isolate the elastomeric disks 332 so that they operate as a series of individual spring members. Spacers 334 are preferably composed of metal or metal alloys, but they could be made of other materials, such as plastic, if desired. Moreover, the spring 330 of the preferred construction is economical to make and assemble on shaft 324. Nevertheless, other kinds of springs could be used. A thrust washer 336 or other means is preferably provided at the rear end of the spring 330 to provide ample support against rear wall 304.

Shaft 324 extends centrally through spring 330 to engage nut 328. The front end of shaft 324 fits into the recess of the stop 320 so that the shaft 324 is set against stop 320 for support. The rear end of lock 106 extends through hole 312 in wear member 104 to enable a user to access the lock 106 outside of opening 300. The shaft 324 is preferably set at an angle to axis 128 so that head 326 is more easily accessed. Spring 330 sets between rear wall 304 and nut 328 so that it can apply a biasing force to the wear member 104 when the lock 106 is tightened. Hole 312 is preferably larger than head 326 to permit its passage during installation of lock 106 into assembly 100. Hole 312 also could be formed as an open slot to accommodate insertion of shaft 324 simply from above. Other tool engaging structures could be used in lieu of the illustrated head 326.

In use, wear member 104 is slid over nose 108 so that nose 108 is fit into socket 120 (FIGS. 2 and 6). The lock 106 can be temporarily held in hole 312 for shipping, storage and/or installation by a releasable retainer (e.g., a simple twist tie), fit around shaft 324 outside of opening 300, or it can be installed after the wear member 104 is fit onto the nose 108. In any event, shaft 324 is inserted through hole 312 and its front end is set in the recess of the stop 320. Lock 106 is positioned to lie along the exterior of nose 108 so that no holes, slots or the like need to be formed in the nose 108 to contain the lock 106 for resisting the loads. Head 326 is engaged and turned by a tool to tighten the lock 106 to a compressive state to hold the wear member 104 (i.e., shaft 324 is turned relative to nut 328 so that front end presses against stop 320). This movement, in turn, draws nut 328 rearward against spring 330, which is compressed between nut 328 and rear wall 304. This tightening of lock 106 pulls wear member 104 tightly onto nose 108 (i.e., with front thrust faces 142, 152 engaged) for a snug fit and less wear during use. Continued turning of shaft 324 further compresses spring 330. The compressed spring 330 then urges wear member 104 rearward as the nose 108 and socket 120 begin to wear. The stability of this preferred nose 108 and wear member 104 arrangement enables the use of an axial lock 106, i.e., no substantial bending forces will be applied to the lock 106 so that the high axial compressive strength of the bolt can be used to hold the wear member 104 to the base 102. Lock 106 is lightweight, hammerless, easy to manufacture, does not consume much space, and does not require any openings in the nose 108.

In one preferred example construction according to this invention, lock 106 also includes an indicator 340 fit onto shaft 324 in association with nut 328. Indicator 340 may be, for example, a plate formed of steel or other rigid material that has side edges that fit closely to sidewalls of opening 300, but not tightly into opening 300. Indicator 340 includes an opening that fully or partially receives nut 328 to prevent rotation of the nut 328 when shaft 324 is turned. The close receipt of side edges of indicator 340 to the sidewalls of the opening 300 prevents the indicator 340 from turning. Alternatively, if desired, the indicator 340 could have a threaded bore to function as the nut 328, and other means could be provide to hold nut 328 and prevent it from turning. Indicator 340 could also be discrete from nut 328, if desired.

Indicator 340 provides a visual indication of when shaft 324 has been suitably tightened to apply the desired pressure to the wear member 104 without placing undue stress on shaft 324 and/or spring 330. In one potential construction in accordance with this invention, indicator 340 cooperates with a marker 342 formed along opening 300, e.g., along rim 310 and/or the opening's interior sidewalls. Marker 342 is preferably on rim 310 along one or both sidewalls, but it could have other constructions. Marker 342 may be, for example, a ridge or some structure that is more than mere indicia so that it can be used when retightening lock 106 after wear begins to develop, as well as at the time of initial tightening when all of the parts are new.

When shaft 324 is turned and nut 328 is drawn rearward, indicator 340 moves rearward with nut 328 within opening 300. When indicator 340 aligns with marker 342, the operator knows that tightening can be stopped. At this position, lock 106 applies a predetermined pressure on wear member 104 irrespective of the wear on the nose 108 and/or in the socket 120. Hence, both under-tightening and over-tightening of the lock 106 can be easily avoided. As an alternative, indicator 340 can be omitted and shaft 324 may be tightened to a predetermined amount of torque.

The large thrust face (142, 152) contact, along with the front and rear stabilizing surfaces (200, 202, 210, 212) and contact between these surfaces and the lock features 106 (e.g., as described above) allow the wear member 104 and nose 108 to wear back much further than many currently available systems (including wear into the thrust face areas) without the need for interim weld repairs. In many instances, an end user can rebuild the nose 108, if desired, in lieu or replacing the entire mounting base 102. Moreover, regardless of wear on the nose 108, the lock 106 helps maintain relatively constant wear member 104 on nose 108 preload forces when a wear member 104 is installed. Aspects of this invention, including the thrust faces 142, 152, the front and rear stabilizing surfaces 200, 202, 210, 212, and/or the lock features 106 (e.g., as described above) increase wear member 104 stability on the nose 108 and lessen movement of the wear member 104 on the nose, thereby reducing wear on the nose and extending its life.

The various aspects of the invention are preferably used together for optimal performance and advantage. Nevertheless, the different aspects can be used individually to provide the benefits they each provide.

CONCLUSION

The present invention is described above and in the accompanying drawings with reference to a variety of example structures, features, elements, and combinations of structures, features, and elements. The purpose served by the disclosure, however, is to provide examples of the various features and concepts related to the invention, not to limit the scope of the invention. One skilled in the relevant art will recognize that numerous variations and modifications may be made to the example structures described above without departing from the scope of the present invention.

The invention claimed is:

1. A wear member for excavating equipment comprising a working section and a mounting section extending generally along a longitudinal axis, the mounting section including a socket for receiving a base fixed to the excavating equipment, and the socket having a front stabilizing end and a rear stabilizing end, the front stabilizing end is forward of the rear stabilizing end, the rear stabilizing end including a plurality of rear stabilizing surfaces, the front stabilizing end including a front thrust surface extending generally transverse to the longitudinal axis, and a top surface, a bottom surface, a first side surface, and a second side surface, each said top surface, bottom surface, first side surface, and second side surface extending rearwardly from the front thrust surface, wherein at least one of the top surface and the bottom surface and each of the first side surface and the second side surface has a transverse, inward projection in the front stabilizing end defined by bearing surfaces that are adjacent to and extend from the front thrust surface substantially parallel to the longitudinal axis in an axial direction.

2. A wear member according to claim 1, wherein the top surface and the bottom surface each has a transverse, inward projection defined by bearing surfaces that are adjacent to and extend axially substantially parallel to the longitudinal axis.

3. A wear member according to claim 1, wherein each of the inward projections is curved and extends substantially across the width of the front stabilizing end.

4. A wear assembly for excavating equipment comprising: a base fixed to the excavating equipment; a wear member comprising a working section and a mounting section extending generally along a longitudinal axis of the wear member, the mounting section including a socket having a front stabilizing end and a rear stabilizing end, the front stabilizing end is forward of the rear stabilizing end, the rear stabilizing end including a plurality of rear stabilizing surfaces, the front stabilizing end including a front thrust surface extending generally transverse to the longitudinal axis, and a top surface, a bottom surface, a first side surface, and a second side surface, each said top surface, bottom surface, first side surface, and second side surface extending rearwardly from the front thrust surface, wherein each of the first side surface and the second side surface has a transverse, inward projection in the front stabilizing end defined by bearing surfaces that are adjacent to and extend from the front thrust surface substantially parallel to the longitudinal axis in an axial direction; and an engagement system for releasably holding the wear member to the base.

5. A wear assembly according to claim 4, wherein the base includes a nose having a front end with an exterior configuration shaped to substantially conform to a shape of the front stabilizing end of the socket.

6. A wear member for excavating equipment comprising a working section and a mounting section extending generally along a longitudinal axis, the mounting section including a socket for receiving a base fixed to the excavating equipment, and the socket having a front end and a rear end, the front end is forward of the rear end, the rear end including a plurality of rear stabilizing surfaces, the front end including a front thrust surface extending generally transverse to the longitudinal axis and a top surface, a bottom surface, a first side surface, and a second side surface, each said top surface, bottom surface, first side surface, and second side surface extending rearwardly from the front thrust surface, wherein each of the first side surface and the second side surface has an inward projection in the front end axially extending from the front thrust surface, and wherein the inward projection extends into the rear end of the socket and substantially along an entire length of the socket, the inward projection having front bearing surfaces in the front end adjacent to the front thrust surface and rear bearing surfaces in the rear end that each axially extend substantially parallel to the longitudinal axis.

7. A wear member according to claim 6, wherein each of the top surface, the bottom surface, the first side surface, and the second side surface has a transverse, inward projection extending from the front thrust face and substantially along the entire length of the socket.

8. A wear member according to claim 7, wherein each of the inward projections is curved and extending substantially across the width of the front end.

9. A wear assembly for excavating equipment comprising: a base fixed to the excavating equipment; a wear member comprising a working section and a mounting section extending generally along a longitudinal axis of the wear member, the mounting section including a socket having a front end and a rear end, the front end is forward of the rear end, the rear end including a plurality of rear stabilizing surfaces, the front end including a front thrust surface extending generally transverse to the longitudinal axis, and a top surface, a bottom surface, a first side surface, and a second side surface, each said top surface, bottom surface, first side surface, and second side surface extending rearwardly from the front thrust surface, wherein at least one of the top surface and the bottom surface and each of the first side surface and the second side surface has an inward projection in the front end axially extending from the front thrust surface and wherein the inward projection extends into the rear end of the socket and substantially along an entire length of the socket, the inward projection having front bearing surfaces in the front end adjacent to the front thrust surface and rear bearing surfaces in the rear end that each axially extend substantially parallel to the longitudinal axis; and an engagement system for releasably holding the wear member to the base.

10. A wear assembly according to claim 9, wherein the base includes a nose having a front end with an exterior configuration including a trough shaped to receive each of the transverse, inward projections of the socket.

11. A wear member according to claim 9, wherein each of the inward projections is curved and extending substantially across the width of the front stabilizing end.

12. A wear assembly according to claim 11, wherein the base includes a nose having a front end with an exterior configuration including a trough shaped to receive each of the transverse, inward projections of the socket.

13. A wear member for excavating equipment comprising a working section and a mounting section, the mounting section including a socket open rearwardly to receive a base secured to the excavating equipment, the socket having a longitudinal axis and including a front end and a rear end, the front end including a front thrust surface, a top side, a bottom side and opposite lateral sides, each of the top, bottom and lateral sides extending rearward of the front thrust face, each of the lateral sides including an inward, axially extending projection defined by bearing surfaces to contact and bear against the base, the bearing surfaces being adjacent to and extend rearward from the front thrust surface in an axial orientation that is substantially parallel to the longitudinal axis, wherein the rear end of the socket is rearward of the top, bottom and lateral sides of the front end.

14. A wear member according to claim 13 wherein each said projection has a generally V-shaped configuration defined by a pair of the bearing surfaces.

15. A wear member according to claim 13 wherein the rear end is defined by a top side, a bottom side and opposite lateral sides each of which extend rearward from the front end, and each of the lateral sides of the rear end include a transverse, inward projection defined by bearing surfaces to contact and bear against the base that are aligned and contiguous with the projections in the front end.

16. A wear member according to claim 13 wherein at least one of the top side and the bottom side includes an inward, axially extending projection defined by bearing surfaces to contact and bear against the base, and the bearing surfaces are adjacent to and extend rearward from the front thrust surface in an axial orientation that is substantially parallel to the longitudinal axis.

17. A wear assembly for excavating equipment comprising:

a base secured to the excavating equipment;

a wear member for excavating equipment comprising a working section and a mounting section, the mounting section including a socket open rearwardly to receive a base secured to the excavating equipment, the socket having a longitudinal axis and including a front end and a rear end, the front end including a front thrust surface, a top side, a bottom side and opposite lateral sides, each of the top, bottom and lateral sides extending rearward of the front thrust face, each of the lateral sides including an inward, axially extending projection defined by bearing surfaces to contact and bear against the base, the bearing surfaces being adjacent to and extend rearward from the front thrust surface in an axial orientation that is substantially parallel to the longitudinal axis, wherein the rear end of the socket is rearward of the top, bottom and lateral sides of the front end; and a lock to contact the base and the wear member and releasably hold the wear member to the base.

18. A wear assembly according to claim 17 wherein each said projection has a generally V-shaped configuration defined by a pair of the bearing surfaces.

19. A wear assembly according to claim 17 wherein the rear end is defined by a top side, a bottom side and opposite lateral sides each of which extend rearward from the front end, and each of the lateral sides of the rear end include a transverse, inward projection defined by bearing surfaces to contact and bear against the base that are aligned and contiguous with the projections in the front end.

20. A wear assembly according to claim 17 wherein the base includes a top wall, a bottom wall and opposite sidewalls, and each of the sidewalls includes a slot corresponding in shape with and receiving the respective projection in the socket.

21. A wear assembly according to claim 17 wherein at least one of the top side and the bottom side includes an inward, axially extending projection defined by bearing surfaces to contact and bear against the base, and the bearing surfaces are adjacent to and extend rearward from the front thrust surface in an axial orientation that is substantially parallel to the longitudinal axis.

* * * * *